United States Patent [19]

Shallenberger et al.

[11] 3,995,782

[45] Dec. 7, 1976

[54] PULVERIZING DEVICE

[75] Inventors: Dennis J. Shallenberger, Latrobe; Charles E. Hill, Whitney, both of Pa.

[73] Assignee: Kennametal Inc., Latrobe, Pa.

[22] Filed: May 22, 1975

[21] Appl. No.: 579,843

[52] U.S. Cl. ..... 241/188 R; 241/191; 241/299

[51] Int. Cl.[2] ..... B02C 13/14

[58] Field of Search ..... 241/197, 188 R, 188 A, 241/189, 190, 191, 275, 292.1, 299

[56] References Cited

UNITED STATES PATENTS

| | | | |
|---|---|---|---|
| 1,876,416 | 9/1932 | Hill | 241/188 R |
| 2,628,038 | 2/1953 | Rogers et al. | 241/197 |
| 2,940,677 | 6/1960 | Jordan | 241/188 R |
| 2,991,949 | 7/1961 | Sellars | 241/299 |
| 3,211,389 | 10/1965 | Sherman, Jr. | 241/188 R |
| 3,503,561 | 3/1970 | Johnson | 241/188 R |
| 3,554,454 | 1/1971 | Gruendler | 241/188 R |
| 3,659,793 | 5/1972 | Stephenson et al. | 241/188 A |

*Primary Examiner*—Roy Lake
*Assistant Examiner*—Neil Abrams
*Attorney, Agent, or Firm*—Melvin A. Crosby; Lawrence R. Burns

[57] ABSTRACT

A pulverizing device is disclosed wherein selected members of the device that are subjected to extreme wear conditions are provided protection from wear by, in some cases, forming the member of the hard wear resistant material and structurally attaching it in the machine or, in other cases, covering the member with a sheet of hard wear resistant material and structurally fastening said sheet in the machine.

10 Claims, 9 Drawing Figures

PULVERIZING DEVICE

BACKGROUND OF THE INVENTION

The invention relates to pulverizing or comminution machines and, more particularly, to pulverizing machines which are comprised of a housing, a steel disc-like rotor rotatable within the housing and having peripheral hammers thereon, a pulverant material inlet means, a pulverized material outlet means, and a linear material on the inside of the housing wall to protect the wall against which some of the pulverant is thrown by the hammers on the disc-like rotor.

In operation of machines with which the present invention is concerned, the material to be pulverized is fed into the housing of the machine via the inlet and comes in contact with the rapidly rotating hammers on the disc-like rotor.

The rotation of the disc-like rotor impacts and pulverizes the pulverant material, some of which impacts the housing liner. The material is pulverized by the hammers on the disc-like rotor, some of which hits the housing liner and is withdrawn from the housing when reduced to the desired particle size.

Heretofore, machines of the above-mentioned description have been made of steel members, but steel abrades away rapidly depending on the pulverant material. Substantially any material, at the high speeds of operation of pulverizing machines, will have a strong abrading effect on even the best steel.

In present pulverizing machines, the steel members wear very rapidly necessitating more or less frequent changing of the rotatable disc-like rotor, depending on the material being pulverized. The maintenance effort to remove the rotatable disc-like rotor and liner from the housing is considerable and is also costly. In a machine of this sort, usually the wear rate is greatest on the hammers first, the surface of the disc-like rotor second and the housing liner third.

The wear rates are of such a ratio to each other that it would be desirable to be able to change the hammers in place on the machine rather than removing the disc-like rotor from the machine or to be able to remove all three of the aforementioned machine parts with a minimum of repair expense and time to refurbish.

To give an example of wear rates in hammers, steel hammers usually must be changed every week. An experiment with ceramic hammers prolonged the life of the hammers to about 2 weeks. With the advent of the present invention, the wear life rate for the hammers is extended to 2 months or more. Wear normally associated with these devices usually centers around (1) the face of the hammers, and (2) the surface of the steel disc-like rotor in the regions thereof adjacent the front and radially inward faces of the hammers.

The wear on the surface of the disc-like rotor takes the form of a dish thereby acting as a hindrance to the outward velocity of the particles just before they hit the liner wall. This hindrance has a detrimental effect on the pulverizing action of the machine. Another action on a very minute scale occurs at the liner wall upon impact. If the wall material is resilient, then some of the impact energy is absorbed by the wall rather than used to break up the pulverant. Pulverizing machines according to the prior art have thus been deficient in respect of the rapid abrasion on the surface of the disc-like rotor. When the disc-like rotor is comprised entirely of a steel body, the aforementioned surface wear renders the entire disc-like rotor useless, requiring a brand new disc-like rotor for replacement. The present invention eliminates the need to change the disc-like rotor as often and provides the opportunity to refurbish the used disc-like rotor on a more economical basis than heretofore contemplated.

With the foregoing in mind, an object of the present invention is to prolong the useful life of existing pulverizing machines.

Another object of the present invention is to provide a greater pulverizing force by reducing hindrances to particle movement.

Still another object of the present invention is to reduce maintenance time on such machines.

Another object of the invention is to provide replaceable hammers that can be replaced without the removal of the rotatable disc-like rotor.

Still another object of the invention is to reduce the amount of wear on certain regions in such machines.

Still another object of the present invention is to provide a greater pulverizing effect by providing harder surfaces to impact against.

BRIEF SUMMARY OF THE INVENTION

According to the present invention, hard wear resistant material such as a cemented hard metal carbide material is advantageously used in pulverizing devices. The top surface of a disc-like rotor used in such machines is provided with a thin sheet which is suitably fastened thereon. The hammers which are usually located on the periphery of the disc-like rotor are formed of a hard wear resistant material also and securely fastened thereon.

A liner wall of a housing in such a pulverizing machine is further provided with a hard wear resistant material lining to prevent abrasion thereof. All elements are arranged to be efficiently interchangeable without any undue downtime for maintenance thereby providing an extremely longer lasting and more efficient machine.

Other objects and a fuller understanding of the invention may be had be referring to the following description and claims, taken in conjunction with the accompanying drawings, in which:

DETAILED DESCRIPTION OF THE INVENTION

Figure 1:
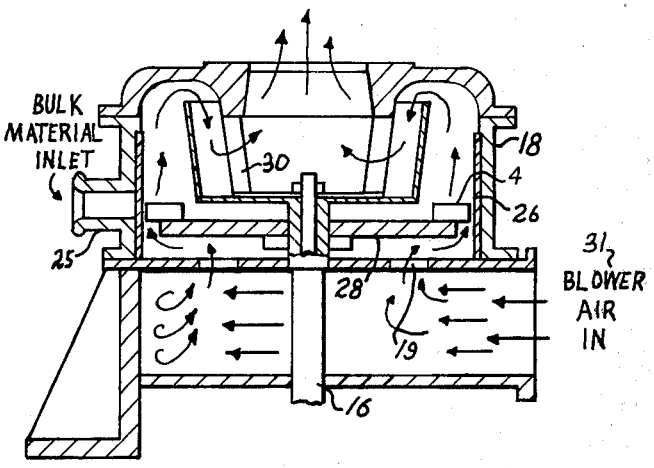
FIG. 1 shows a pulverizing machine incorporating the present invention.

Referring to the drawings somewhat more in detail, FIG. 1 represents a typical machine to which the present invention can be applied. The pulverizing machine in FIG. 1 comprises a housing 18, a rotatable disc-like rotor 28, a housing liner assembly 26, a pulverant material inlet line 25, a screen 30 at the top of the housing 18 and an air blower 31 connected to the bottom of the housing, hammers 4 connected to rotatable disc-like rotor 28, drive shaft 16, and air holes 19.

The complete operation of the machine is as follows: Bulk pulverant material is fed through inlet line 25 and inside housing 18 and into the path of the hammers on rotatable disc-like rotor 28. Rotatable disc-like rotor 28 is rotated by drive shaft 16 at a speed of up to 7,000 RPM in the direction of the arrow.

The rotation provides outward momentum to keep the pulverant particles radially outward on the surface of the disc-like rotor 28 until the particles come in contact with hammers 4 which provide impact for pulverization.

The fine particles that result from the above described operation are then lifted by blower air circulation from air blower 31 toward the top of the housing 18. A screen 30 is provided concentric to the center portion of housing 18 and allows fine particles to pass while stopping large particles. The large particles are recycled in the machine for further reduction.

Figure 2:
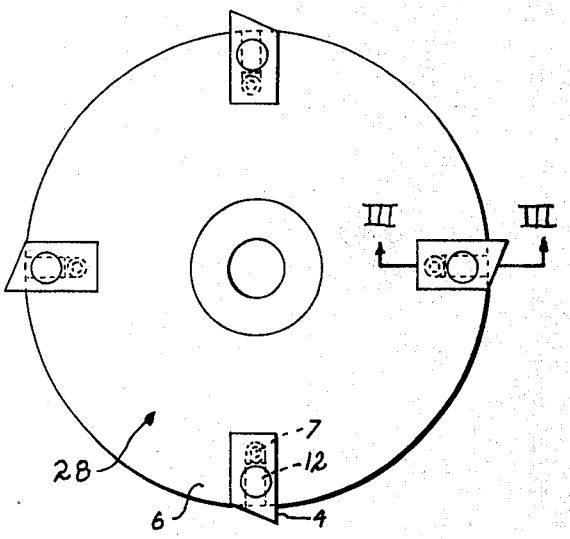
FIG. 2 shows a rotatable disc equipped with hammers according to the present invention.
Figure 3:
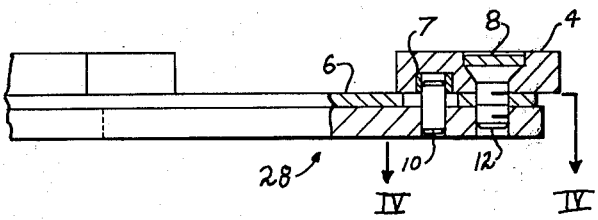
FIG. 3 is a sectional view taken on line III—III of FIG. 2.
Figure 4:
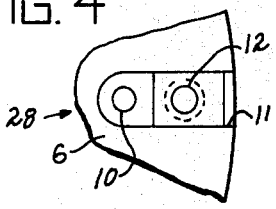
FIG. 4 is a sectional view taken on line IV—IV of FIG. 3.

FIG. 2 is a top view of the rotatable disc-like rotor showing one modification proposed by this invention. In this type of construction, a hard wear resistant surface member 6 is mounted on the disc and is a one piece construction with hammers 4 being shown attached near the outer periphery thereof. The hammers may extend past the peripherey of the disc-like rotor. A more detailed showing of the construction will be seen in FIG. 3.

The upper face of disc-like rotor 28 is provided with a one piece cemented hard metal carbide sheet 6 which is thin in cross section and which has parallel top and bottom faces. The bottom face of the sheet mates with, covers and is fastened to the upper face of the disc-like rotor by an epoxy mixture.

A radial slot 11 or aperture is provided in the disc beneath each of the hammers 4 for elements 10 and 12. Element 10 is a hardened cylindrical locating pin which forms an interference fit with the corresponding hole in the rotatable steel disc-like rotor when the pin is inserted to approximately half the length of the pin therein.

The top part of the pin 10 extends into a hole formed in hammer 4 and which extends vertically through the bottom face of hammer 4 for a little bit more than half the length of pin 10 but does not intersect the top face of hammer 4. A bushing 7 is placed in the hole formed in hammer 4 and surrounds the protrusion of the locating pin with an interference fit providing for position location and rigidity of hammer 4.

Bushing 7 may be formed of a tungsten alloy sold under the Trademark KENNERTIUM. A threaded hole is formed in the periphery of the steel disc-like rotor radially outwardly from each pin 10.

A threaded bolt 12 is inserted downward through a counterbored clearance hole in the hammer 4 and threadedly engages the hole in the periphery of the steel disc-like rotor thereby firmly clamping hammer 4 to the cemented hard carbide sheet on the disc-like rotor. This arrangement protects the head of the threaded bolt from excessive wear during operation. To provide for excess and ease of replacement, another small disc 8 of a cemented hard carbide is suitable fastened in place, in this case, also, by an epoxy cement, in a recess formed in the top face of hammer 4 above the head of bolt 12 and larger in diameter than the counterbore in which the head of bolt 12 is disposed.

Hammers 4 are also formed of a cemented hard metal carbide material, such as cemented tungsten carbide, or a mixture of hard metal carbides. A cementing metal can be a metal of the iron group, cobalt, for example.

Figure 5:
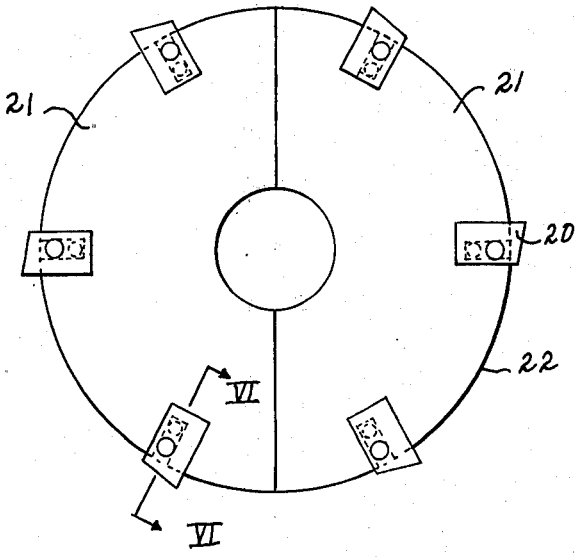
FIG. 5 shows a modification of the rotatable disc-like rotor with hammers.

Referring to FIG. 5, an alternate form of construction can be seen in which the cemented hard carbide surface material is a two piece construction rather than the aforementioned one piece. These two pieces are in the form of half discs 21 such that when laid on the surface of the steel disc-like rotor, indicated at 22 in FIG. 5, the half discs abut each other on a diameter of said steel disc and cover the same area as the one piece construction except for the apertures under the hammer 20. Hammers 20 are also formed of cemented hard carbide material.

Figure 6:
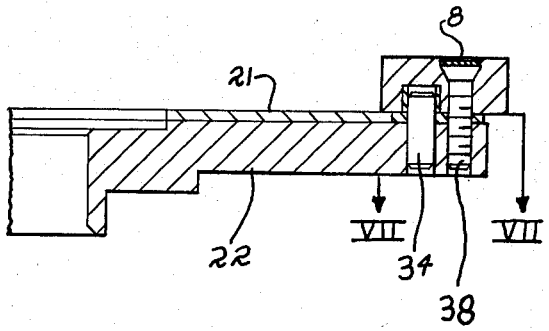
FIG. 6 is a sectional view taken on line VI—VI of FIG. 5.
Figure 7:
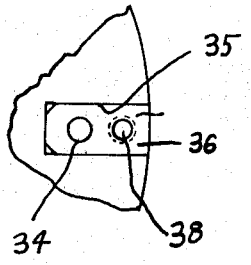
FIG. 7 is a sectional view taken on line VII—VII of FIG. 6.

The arrangement for securing hammers 20 to disc 22 may be seen more clearly by reference to FIG. 6. A cylindrical locating pin 34 is used as described before except in this case a rectangular steel insert 36 of about the same thickness as the half discs 21 is placed between each hammer 20 and the surface of the rotatable disc-like rotor 22, this insert abutting the radially outward facing edge of a radial notch 35 formed in the respective cemented hard carbide half disc.

The steel inserts are held firmly in place by the hardened locating pin and by a threaded bolt 38 as described before but in this case the alignment of the pins and bolt are on the same radius of the steel disc-like rotor.

The steel inserts provide an additional counteracting force for centrifugal forces tending to move the cemented hard carbide half discs radially outward during operation. Depending on the number of hammers employed, the spatial relationship of the underlying steel inserts is a factor in providing uniform support for the cemented hard carbide half disc portions and, therefore, hammer locations can become of strategic importance for support (see FIG. 5).

Figure 8:
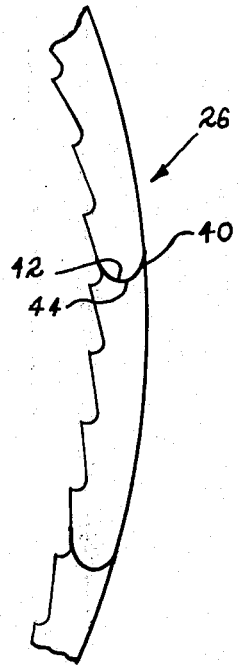
FIG. 8 shows a top view of a typical housing liner assembly.

FIG. 8 is a view looking down on the side wall liner assembly 26 in FIG. 1. The assembly consists of several arcuate segments of molded cemented hard carbide material, the radially outward sides of which are smoothly cylindrical for abutment with the inside wall of the machine housing 18 but the radially inwardly facing sides of which may take any form desired from a sawtooth configuration, as shown in FIG. 8, to being smooth and concentric with the radially outward wall.

The height of each segment can be varied as required in different machines, but the end regions of the segments are preferably formed with curved end abutment regions 42 which will abut a complementary shaped end 44 on the adjacent segment. The joints between adjacent segments are preferably filled with an epoxy cement as indicated at 40. The segments form a continuous annular surface inside the vertical side wall of the housing.

Figure 9:
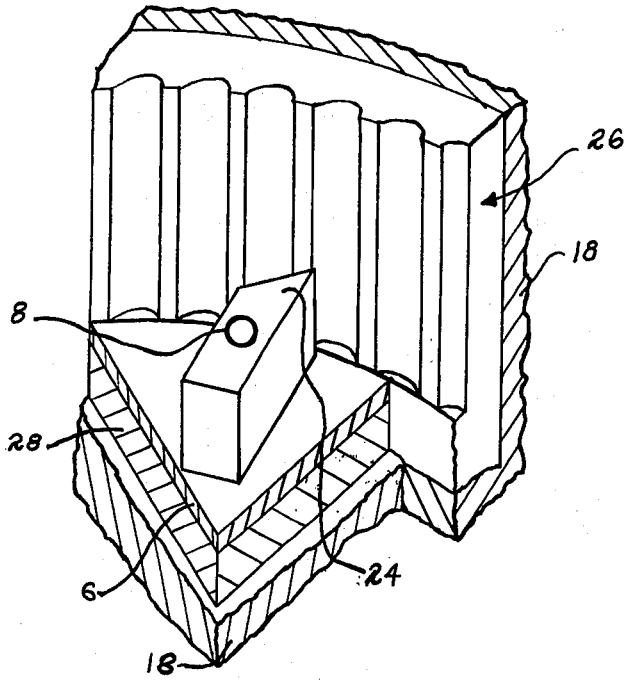
FIG. 9 is a perspective view showing the relationship of the disc-like rotor, hammers and inner wall of the housing.

FIG. 9 shows a perspective view of an outside edge of the rotatable steel disc-like rotor equipped with a cemented hard carbide surface and a carbide hammer.

Shown in FIG. 9 is the pulverizing machine housing 18 containing inside of it the individual elements such as: the wall liner 26 made of a cemented hard carbide material which can by any height desired and having a thin cross section which may be determined by the shaping desired on the inner face of the liner; the rotatable disc-like rotor 28 comprising a body of steel with a surface member 6 made of a hard cemented carbide material of either a one or two piece construction and cemented to the wear surface of the disc-like rotor; the hammers 24 which may take any shape desirable but are made of a cemented hard carbide material and fastened securely on the top side of surface member 6 by a bolt threadedly engaging the disc-like rotor and having a small disc 8 made of a cemented hard carbide material epoxyed into place in a recess in the hammer and above the fastening element to prevent abrasion on the fastening element.

Modifications may be made within the scope of the appended claims.

What is claimed is:

1. In a comminution machine having a cylindrical housing, a pulverant inlet means for receiving material to be pulverized, a disc-like rotor, rotatable on an axis in the housing, hammers located on one side of the disc-like rotor near the periphery and a housing liner located on the inside of the housing and surrounding the disc-like rotor, the improvement which comprises a sheet of cemented hard carbide material which is thin relative to the disc-like rotor's thickness securely fastened to the said one side of said rotor beneath said hammers, said sheet divided into parts along a plane of a diameter of the rotor and having apertures beneath at least one of said hammers, and a metal insert filler in each aperture engaging a radially outward facing edge of the respective aperture to hold the sheet against radial movement on the rotor, a pin in the rotor extending through each aperture and a bore in said metal filler element so as to engage a downwardly opening hole in the respective hammer, and a bolt spaced from each pin and extending downwardly through a bore formed in the respective hammer and threaded into the rotor to clamp the hammer to the rotor.

2. The improvement according to claim 1 which further includes the housing liner formed in circumferential segments having end regions which interfit with the end regions of similar adjacent segments and the joints between adjacent segments closed with epoxy cement.

3. The improvement according to claim 2 in which said segments have smooth outer walls that engage the inside of the housing and have inner walls which are serrated in configuration when viewed in the axial direction.

4. The improvement according to claim 1 in which said hammers are substantially cubical and protrude peripherally from said rotor to near said liner.

5. The improvement according to claim 1 in which there is a bore in each hammer for receiving a respective bolt and said bore has a recess formed in the end remote from the rotor, and a small disc of cemented hard carbide material fixed in each said recess.

6. The improvement according to claim 2 in which said segments have smooth outer walls engaging the inside of the housing and have inner wall which are saw teeth in configuration when viewed in the axial direction and have their radial faces facing the approaching hammers.

7. The improvement according to claim 1 in which the parts of said sheet are bonded to the surface of the disc-like rotor by an epoxy bonding material.

8. The improvement according to claim 1 in which the plane of the diameter dividing said sheets into parts is equadistant from the nearest hammers located on the periphery of the disc-like rotor.

9. The improvement according to claim 1 which further comprises said hammer formed of a cemented hard metal carbide material.

10. The improvement according to claim 1 which further comprises said housing liner formed of a cemented hard metal carbide material.

* * * * *